United States Patent [19]

Watai et al.

[11] Patent Number: 4,533,234

[45] Date of Patent: Aug. 6, 1985

[54] AUTOMATIC DENSITY CONTROL METHOD FOR A PHOTOCOPYING MACHINE

[75] Inventors: Yuji Watai; Hirokazu Yasui; Yoshiyuki Hirayama; Akira Matsuura, all of Kanagawa, Japan

[73] Assignee: Fuji Xerox Co., Ltd., Tokyo, Japan

[21] Appl. No.: 404,739

[22] Filed: Aug. 3, 1982

[30] Foreign Application Priority Data

Aug. 3, 1981 [JP] Japan ..... 56-122319

[51] Int. Cl.[3] ..... G03G 15/00

[52] U.S. Cl. ..... 355/14 D; 355/14 R; 355/14 E; 118/665

[58] Field of Search ..... 355/14 R, 14 D, 14 E, 355/77, 14 C; 118/647, 665, 668, 688, , 691; 430/30

[56] References Cited

U.S. PATENT DOCUMENTS 2,956,487 10/1960 Giaimo, Jr. ..... 355/14 D
4,082,445 4/1978 Steiner ..... 355/14 D
4,341,461 7/1982 Fantozzi ..... 355/14 D
4,372,672 2/1983 Pries ..... 355/14 R

OTHER PUBLICATIONS

*IBM Technical Disclosure Bulletin,* vol. 19, No. 11, Apr. 1977, Smith, G. L., "Toner Concentration Control."

*Primary Examiner*—A. T. Grimley
*Assistant Examiner*—J. Pendegrass
*Attorney, Agent, or Firm*—Sughrue, Mion, Zinn, Macpeak, & Seas

[57] ABSTRACT

A density controlling method for controlling the density of toner applied to the surface of a photosensitive drum of a photocopying machine is disclosed herein. A small area of the drum is irridated with light, and toner is applied thereon. A photo-transistor sensor senses the density of the toner, and a signal produced by the sensor is compared to a reference signal indicative of optimal toner density. The difference signal is then applied through a CPU to control both the bias voltage of the developing system and the speed of the toner motor.

8 Claims, 5 Drawing Figures

TO MOTOR 5 AND UNIT 7
CPU
15
DARK
NORMAL
LIGHT
OPE AMP
12
22
LP
21
E'ref
AUTO V-CNTRL
20
18
19
17
16
11

VOLTAGE
DET. OUTPUT OF PHOTO-TR. 11

VOLTAGE
OUTPUT OF LPF

VOLTAGE
SAMPLINGS

AUTOMATIC DENSITY CONTROL METHOD FOR A PHOTOCOPYING MACHINE

BACKGROUND OF THE INVENTION

This invention relates generally to automatic density control for a copying machine.

In general, the capability of a copying machine changes with time. For instance, the density of a copy varies as either the supply of toner becomes inadequate or the developing bias voltage changes. Accordingly, it is necessary to automatically control these two factors both before or between copying operations. In order to do so, the copying machine should preferably be operated on a trial basis; however, during this operation, a large amount of toner is consumed. In order to eliminate this difficulty, in the prior art density controllers produce toner which is allowed to stick to only a small area (typically 35 $cm^2$) of the surface of the photosensitive drum for the purposes of density testing.

In the technology of this invention, a developing bias voltage is controlled by feeding back the density thus detected, since a bias voltage responds to a control signal quickly. However, since it is difficult to completely control the density merely by controlling the developing bias voltage, the rotation of a toner supply motor is also controlled in the present invention.

An automatic control of this type has been known in the art; however, a number of factors such as the light intensity of a lamp, charge current, developing bias voltage and the density of toner must also be controlled in such prior art system. As such, these prior art density control systems are unduly complicated and highly unreliable. The above-described method of utilizing a small part of the surface of the drum has also been proposed in the art; however, in the conventional method, two areas are selected in such a manner that one of the two areas is high in toner density, while the other is low in toner density. The densities of the two areas are subjected to comparison to determine a suitable density. This method is also intricate to control and is not practical.

SUMMARY OF THE INVENTION

It is thus an object of the present invention to provide an automatic density control method for a photocopying machine which is practical in operation while being relatively simple in design.

The foregoing and other objects of the present invention are realized by a density control system which utilizes only one small portion of the surface of the photosensitive drum to determine the amount of toner being supplied to the drum. Further, only the rotation of the toner supply motor and the bias voltage for the developing equipment are varied to effect density control, resulting in a density control system which is generally more practical in operation and simple in design than the control systems of the prior art.

BRIEF DESCRIPTION OF THE DRAWINGS

The present invention will now be discussed in detail with reference to the accompanying drawings, in which.

DETAILED DESCRIPTION OF THE PREFERRED EMBODIMENT

Figure 1:
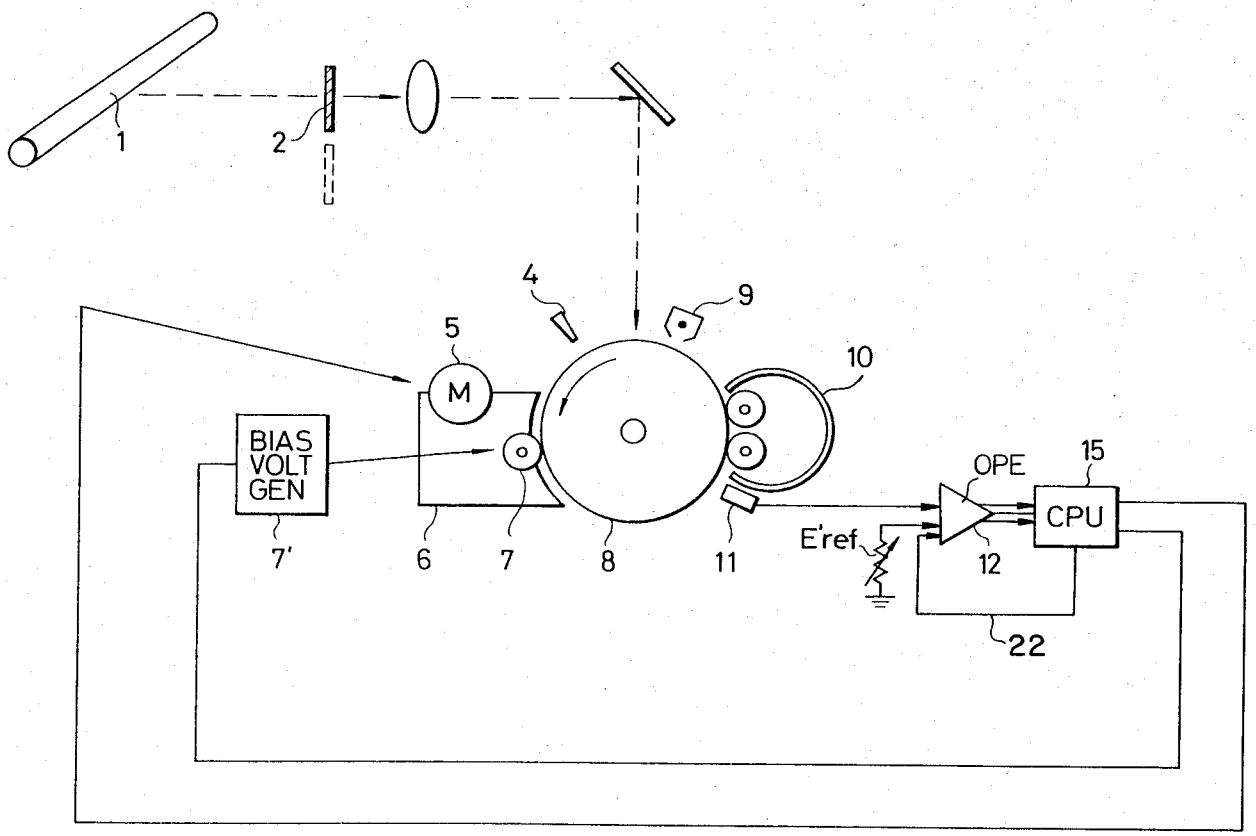
FIG. 1 is a schematic diagram of a photocopying machine modified to practice the density controlling method of the present invention.

FIG. 1 outlines the optical system for a photocopying device which practices the automatic density control method according to the present invention. In FIG. 1, reference numeral 1 designates an exposure lamp; 2, an exposure attenuating plate; 4, a residual charge eliminating lamp; 5, a toner supplying motor; 6, a developing unit; 7, a developing bias electrode; 8, a photosensitive drum (or selenium photosensitive member); 9, a charge corotron; 10, a cleaning unit; 11, a density reading sensor; and 12, a voltage comparison operational amplifier.

In making a trial sample of sticking toner in order to determine the toner density, the exposure attenuating plate 2 is caused to intercede into an optical path between the exposure lamp 1 and the drum 8 by a solenoid. The motion of the attenuating plate 2 provides a light "gap" in time in which residual charges can be dispersed uniformly over the surface of the drum 8. Then, the timing and selection of a plurality of light emitting diodes (LED's) 4, which are arranged over the width of the drum, are controlled to form a trial toner sticking area of typically 35 $cm^2$ in area on the drum 8. Thus, if toner is stuck to the surface of the drum in a conventional manner, the density thereof can be read by the density reading sensor 11 disposed along the periphery of the drum. The sensor 11 generates a detection signal which is applied to the operational amplifier 12, where it is compared with a reference voltage E ref which is defined according to an optional density which is most suitable for the particular photosensitive copying machine. The resulting difference signal is applied through a CPU 15 to a bias voltage generator 7', which controls the bias voltage of the developing unit. The output of the CPU is also provided to the toner supplying motor 5 to control the speed of the latter, controlling the amount of toner supplied to the drum 8. The CPU can be selected from any of a number of known commercially available devices.

Figures 2, 3A, 3B, 3C:
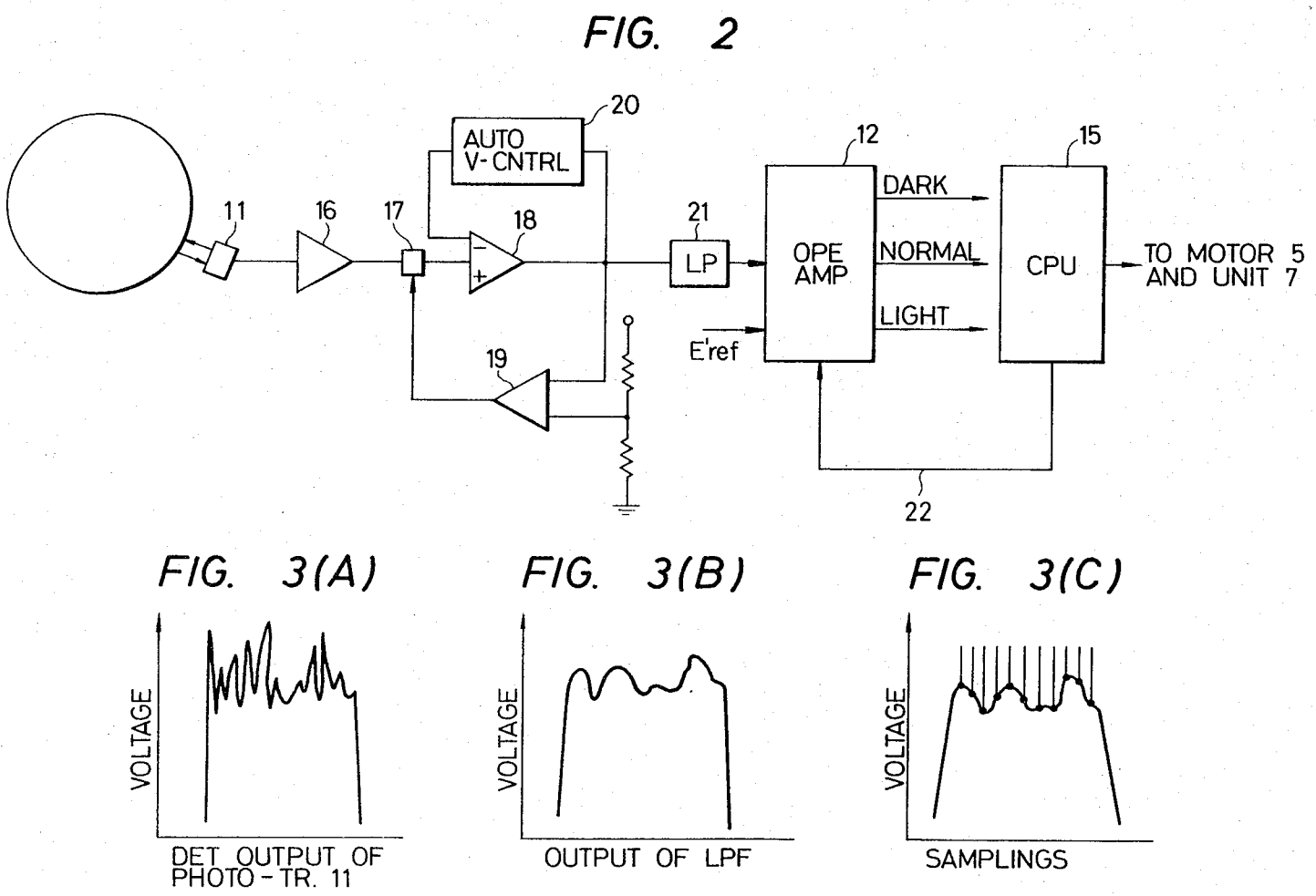
FIG. 2 is a schematic diagram of the control system of the present invention.
FIGS. 3(A)-3(C) are graphs showing the voltage level of the density sensing signal at various points along the density control system of FIG. 2.

FIG. 2 is a diagram showing the signal processing circuit between the density reading sensor 11 and the CPU 15 of FIG. 1 in greater detail. The sensor 11 is a photo-transistor, the output of which is applied through a preamplifier 16 and a signal attenuator 17 to a differential amplifier 18. The output of the differential amplifier 18 provides positive feedback through a comparator 19. The output also provides negative feedback to amplifier 18 through an automatic voltage controller 20. The signal of the amplifier 18 is then applied through a low-pass filter 21 to the comparator 12 (as shown in FIG. 1), where it is compared with the optimum voltage signal. As a result, the comparator produces an output signal indicative of the fact that a density read by the sensor 11 is either too high, is suitable or, is too low with respect to the photosensitivity of the drum 8. The output signal is then applied to the CPU 15. Originally, the read outputs of the photo-transistor 11 are liable to be variable and erroneous as shown in FIG. 3(A). In order to eliminate this drawback, a feedback circuit 22 is provided between the comparator 12 and the CPU 15, to sample the output signal several tens of times to stabilize the value of the output signal. The output signal thus stabilized is applied to the CPU 15.

FIG. 3(B) is a diagram showing the output signal of the low-pass filter 21, and FIG. 3(C) shows the resulting sampling pattern.

With the above-described arrangement, copying density can be controlled quickly and effectively with high reliability and less toner consumption.

What is claimed is:

1. In a photocopying device in which a light source transmits light through an optical path to the surface of a photosensitive drum, said device comprising means for supplying toner at a certain density to the surface of said drum, means for generating a signal indicative of an optimal value of said density of said toner, means for developing an image upon said drum, and means for cleaning said surface of said drum, a density sensing and controlling method, comprising the steps of:

interrupting said optical path of said light source;

exposing light to a small area of said photosensitive drum;

applying said toner to said exposed area of said photosensitive drum;

sensing the density of said toner on said drum, and producing an output signal indicative of said sensed density;

comparing said output signal with said signal indicative of an optimum toner density;

producing a control signal as a function of said comparison;

sampling and stabilizing said control signal; and controlling both of said developing means and said toner supplying means as a function of said stabilized control signal.

2. In a photocopying device in which a light source transmit light through an optical path to the surface of a photosensitive drum, said device comprising means for supplying toner at a certain density to the surface of said drum, means for developing an image upon said surface of said drum, and means for cleaning said drum, a density controlling system comprising:

means for generating a signal indicative of an optimal value of said density of said toner;

means for sensing the amount of toner supplied to said surface of said drum by said toner supplying means and producing an output signal indicative of said sensed density;

means for comparing said output signal indicative of said sensed density with said signal indicative of said optimal density and producing a control signal;

means for sampling and stabilizing said control signal; and means for controlling both of said developing means and said toner supply means as a function of said stabilized control signal.

3. The density sensing and controlling method of claim 1, wherein said step of exposing light to a small area of said photosensitive drum is completed by controlling the selection and energising sequence of a plurality of discrete light sources arranged over the width of said photosensitive drum.

4. The density sensing and controlling method of claim 1, wherein said signal indicative of an optimal value of said density of said toner is generated as a function of a light sensitivity of said photosensitive drum.

5. The density-sensing and controlling method of claim 1, wherein said developing means comprises a developing unit and at least one bias electrode having a bias voltage and said toner supplying means comprises a toner supplying motor, and wherein said step of controlling both of said developing means and said toner supplying means is completed by controlling the bias voltage of said bias electrode of said developing means and by controlling the speed of said toner supplying motor of said toner supplying means.

6. The photocopying device of claim 2 wherein said means for comparing comprising an operational amplifier comparator and said control signal is indicative of whether sensed density is too high, too low or suitable with respect to the photosensitivity of the drum.

7. The photocopying device of claim 6 wherein said means for controlling comprises a central processing unit and said means for sampling and stabilizing comprises a feedback circuit between said central processing unit and said comparator.

8. The photocopying device of claim 2 wherein said means for sensing the amount of toner and producing an output signal comprises; a phototransistor sensor, signal processing means responsive to the output of said phototransistor sensor and a low pass filter to produce an output signal indicative of said sensed density.

* * * * *